United States Patent [19]

Okubo et al.

[11] Patent Number: 4,953,800

[45] Date of Patent: Sep. 4, 1990

[54] YARN WINDING DEVICE

[75] Inventors: Tadahiko Okubo; Jun Takagi; Tadashi Kohara, all of Otsu, Japan

[73] Assignee: Toray Engineering Co., Ltd., Osaka, Japan

[21] Appl. No.: 473,114

[22] Filed: Jan. 31, 1990

Related U.S. Application Data

[63] Continuation of Ser. No. 414,584, is a continuation of Ser. No. 143,938, Jan. 14, 1988, abandoned.

[30] Foreign Application Priority Data

Jan. 16, 1987 [JP] Japan ..... 62-008828
Aug. 17, 1987 [JP] Japan ..... 62-204407

[51] Int. Cl.[5] ..... B65H 59/38
[52] U.S. Cl. ..... 242/45; 242/18.1
[58] Field of Search ..... 242/45, 36, 18 R, 18 DD, 242/18.1

[56] References Cited

U.S. PATENT DOCUMENTS

| | | | |
|---|---|---|---|
| 2,036,441 | 4/1936 | Swanson | 242/18.1 |
| 2,355,634 | 8/1944 | Doughty, Jr. | 242/45 |
| 2,402,739 | 6/1946 | Doughty, Jr. | 242/45 |
| 2,752,105 | 6/1956 | Keith | 242/45 |
| 3,638,872 | 2/1972 | Jennings | 242/18.1 |
| 3,908,920 | 9/1975 | Hermanns | 242/45 |
| 4,245,794 | 1/1981 | Hasegawa et al. | 242/45 |
| 4,500,043 | 2/1985 | Brown | 242/45 |

FOREIGN PATENT DOCUMENTS

| | | |
|---|---|---|
| 1912374 | 5/1970 | Fed. Rep. of Germany . |
| 2716017 | 8/1978 | Fed. Rep. of Germany . |
| 2380212 | 9/1978 | France . |
| 8001272 | 6/1980 | PCT Int'l Appl. . |
| 893350 | 4/1962 | United Kingdom . |

*Primary Examiner*—Stanley N. Gilreath
*Attorney, Agent, or Firm*—Finnegan, Henderson, Farabow, Garrett & Dunner

[57] ABSTRACT

A yarn winding device which comprises a yarn feeding unit for feeding a yarn at a predetermined yarn speed, an absorbing unit for absorbing a variation of a yarn speed by storing the yarn therein, a tensioning unit for applying a predetermined tension to a yarn, and a yarn winding unit for winding a yarn on a bobbin while traversing the yarn. A yarn detecting unit is provided for detecting whether or not a yarn is in front thereof in the absorbing unit and a control unit is also provided for controlling yarn winding speed of the yarn winding unit by increasing and decreasing that speed in accordance witha signal from the yarn detecting unit indicating a yarn existence or non-existence. After all, this yarn winding device makes a cone cheese package or a ribbonless package under constant tension by using an absorbing means between a feeding unit and a winding package.

23 Claims, 9 Drawing Sheets

YARN WINDING DEVICE

This application is a continuation of application Ser. No. 07/414,584, filed Sept. 27, 1989, now abandoned, which is a continuation of application Ser. No. 07/143,938 filed Jan. 14, 1988, now abandoned.

BACKGROUND OF THE INVENTION

1. Field of the Invention

This invention is related to a yarn winding device in which a yarn produced by a spinning machine, a false twisting machine, a rewinding machine or the like is wound in the form of a square cheese, a biconical cheese, a cone or the like.

2. Description of the Related Art

Generally speaking, in methods of producing a yarn by using, for example, so called innovated spinning machines such as an open end spinning machine, an air spinning machine or the like, or a false twisting machine and a draw-texturing machine or the like, the yarn produced or treated in such a yarn forming or a yarn processing device thereof is delivered therefrom by a delivery roller at a predetermined yarn speed and fed to a yarn winding means, and thereafter, wound on a bobbin by a yarn winding means as a package, i.e., a so-called square cheese, biconical cheese, cone or the like.

The above mentioned yarn winding means usually consists of a guide provided at a traversing point for guiding a yarn to a predetermined position, a roller having a groove on a surface thereof and rotated at a predetermined revolving speed by a driving means, and a cradle for rotatably supporting a bobbin and swingably mounted on an axis provided on a frame of a machine. The yarn delivered from a yarn processing portion is wound up onto a bobbin rotated by a contact friction driving method with a roller having a groove by which the yarn is traversed.

On the other hand, a yarn may be traversed by a traversing guide connected to a rotary scrolling cam, whereby the yarn is traversed in a direction parallel to a surface of a bobbin. When a yarn is wound onto a bobbin to form a package, such as a square cheese, a biconical cheese, or the like, by the yarn winding means mentioned above, a problem arises in that, during the yarn traversing, a yarn tension in a yarn winding process will become relatively high when reaching one end of a traversing range, but this tension will become relatively low when moving back to the center of the traversing range, because of a difference in the yarn length from a guide for a traversing point to an end portion of the range and the length of the yarn from a guide for a traversing point to a center point of the traversing range thereof.

Therefore, an edge projection on both ends of a package is often caused by an accumulation of yarn on the edge thereof or an edge collapse on a surface of a package caused by a relatively high hardness of a wound bobbin occurs.

Also a problem arises in that a difference of a hardness on a bobbin will occur at the end of a package and at the center portion of the package.

This problem will frequently arise in the case of a yarn wound on a bobbin by a soft winding method.

On the other hand, when a yarn is wound onto a package in the form of a conical cheese, a cradle provided with a mechanism to hold a bobbin at a certain inclination against a driving roller having a cylindrical shape is used to give one end of the package a relatively large diameter and the other end thereof a relatively small diameter, as an increment of a package diameter wound thereon. But during a yarn winding operation of this method, the yarn winding tension will greatly vary between an one end portion of a package having a large diameter and the other end portion thereof having a small diameter, and a contact pressure between a package and a driving roller also will be varied because of, for example, yarn accumulation, difference in hardness of a package at both ends thereof, and a cradle setting error, therefore the package is not more often driven at the center portion of a driving roller than at one end portion of the package having a large diameter or at the other end portion having a small diameter Accordingly, when a package is driven on one end portion thereof having a large diameter yarn breakage will occur because the yarn winding speed is decreased, resulting in an increase of slack portions thereof and errors in the control of a yarn pass. On the other hand, when a package is driven on the other end portion thereof having a small diameter, yarn breakage will also occur because the yarn winding speed is increased resulting in a increase of the yarn winding tension.

As can be seen from the above description, the problems of yarn breakage, an edge projection on both ends of a package, and an edge collapse on a surface of a package are caused by variations in the tension, which occurs because of the difference in the winding diameter and variations of a driving point. Therefore, a method in which an absorbing means for mechanically absorbing a variation of a yarn speed, such as a tension compensator, is used to reduce the variations in yarn tension has been disclosed.

A typical absorbing means for mechanically absorbing variations of a yarn speed is disclosed in Japanese Examined Patent Publication No. 61-19541, but even by using such an absorbing means, the above problems still exist, in that a simultaneous compensation of a yarn tension can not be implemented when there is a variation in a yarn tension, because a cycle of a variation of a yarn tension is shortened when a yarn winding speed exceeds 200 m/min, and thus interferes with an inherent vibration of the absorbing means, finally, the yarn winding operation can not be continued.

Further, when using a cone cheese as a package, if a tapered angle thereof exceeds 2°, variations of a yarn tension will become large and a cycle of a variation of a yarn tension will be shortened, and therefore, a compensation of a yarn tension can not be carried out for the same reason as mentioned above; therefore, it has been a problem to use such a system in actual practice The object of the invention is to provide an apparatus for winding a yarn onto a package such as a square cheese, biconical cheese or cone cheese having a tapered angle of at least 2°, in a winding configuration comprising a soft winding or a hard winding to provide a package having a uniform hardness and a uniform shape.

SUMMARY OF THE INVENTION

To attain the object of the present invention mentioned above, there is provided a yarn winding device comprising, a yarn feeding means for feeding a yarn at a predetermined yarn speed, an absorbing means for absorbing a variation of the yarn speed by storing the yarn therein, a tensioning means for applying a predetermined tension to a yarn, and a winding means for winding a yarn on a bobbin while traversing the yarn, all of the above means being arranged in this order to provide a device. The present invention is further characterized by the provision of a yarn detecting means for detecting whether or not a yarn is in front thereof and a control means for controlling a yarn winding speed of a yarn winding means by increasing and decreasing that speed in accordance with a signal from the yarn detecting means indicating a yarn existence or non-existence.

BRIEF DESCRIPTION OF THE DRAWINGS

FIG. 13A is an enlarged cross sectional view showing the clutch in an unengaged position.

FIG. 13B is an enlarged cross sectional view showing the clutch in an engaged position.

DESCRIPTION OF THE PREFERRED EMBODIMENTS

Embodiment of a configuration of a yarn winding device of this invention will be described as examples thereof with reference to the accompanying drawings, but this invention is not restricted to these examples.

Figure 1:
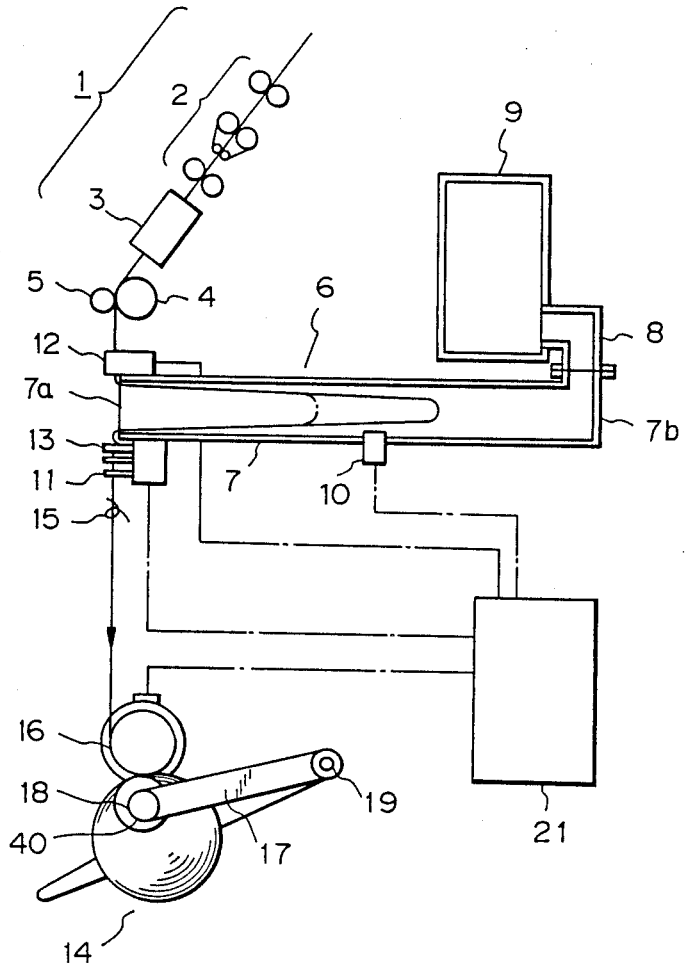
FIG. 1 is a schematic side view of one embodiment of a spinning machine to which a yarn winding device of this invention is applied.

As shown in FIG. 1, a yarn forming means of an innovated yarn spinning machine such as an open end spinning machine or an air spinning machine 1 consists of drafting rollers 2, a yarn forming part 3, a delivery roller 4, and a nip roller 5.

The delivery roller 4 is connected to a driving means (not shown) of the drafting rollers 2 through rollers, for feeding a yarn and mounted on a line shaft of the delivery roller 4.

A rubber nip roller 5 or an apron belt is placed in contact with a delivery roller 4 at a predetermined surface pressure, by a suitable pressure mechanism such as a spring (not shown). An absorbing means for absorbing a variation of a yarn speed 6, consisting of a vacuum box 7 having a negative pressure, is provided adjacent to a portion under the delivery roller 4, and has a rectangular crosssection or the like, and a vacuum duct 9 is connected to bottom end 7*b* thereof through a pipe 8 to store the yarn inside the vacuum box 7 in, for example, a U-shape by sucking the yarn into the vacuum box 7 through a suction aperture 7*a*.

A yarn detecting means 10 is provided substantially at a point midway between the suction aperture 7*a* and the bottom end portion 7*b* of the vacuum box 7, for detecting the existence or non-existence of a yarn. Various detectors, for example, a light transparent type, a light reflection type, an electrostatic capacity type, and a piezo electric element type or the like, may be used as the yarn detecting means 10 as long as the detector can detect whether a yarn sucked therein in the shape of a U, for example, exists or does not exist at a position in front of the detecting means 10 in the vacuum box 7, and send a signal indicating a yarn existence or non-existence to a control means 21.

A plurality of vacuum boxes 7 are provided on the vacuum duct 9, one end of which is connected to a blower through a waste box (not shown).

A tensioning means 11 is provided on a portion adjacent to and beneath the absorbing means for absorbing a variation of a yarn speed, a portion of which is affected by the suction force of the vacuum box 7. As the tension means 11, a well known disc type tensor or finger type gate tensor can be used in this invention, to give a predetermined tension to a yarn while it is wound on a bobbin.

A yarn detecting device 12 is provided adjacent to and over the vacuum box 7 or adjacent to and beneath the tensioning means 11, to detect a stable running and a slub or the like of a yarn.

A yarn cutting means 13 is also provided adjacent to and ahead of the tensioning means 11 and is controlled in such a way that it is actuated when the tensioning means 11 is not actuated and is not actuated when the tensioning means 11 is actuated. In other words, when the yarn is being wound in a normal condition, the tensioning means 11 is actuated to apply a suitable tension to the yarn being wound during the yarn winding operation and the yarn cutting means 13 is not actuated, i.e., is not operated to cut the yarn, by a suitable switching device. But when a slub or an attenuated portion of the yarn is detected by the yarn detecting device 12, the yarn winding operation is stopped and the yarn tensioning means 11 deactuated and simultaneously the yarn cutting means 13 is actuated as a result of the detection of the yarn defect by the yarn detecting device 12, to cut the yarn utilizing a suitable switching device.

A yarn winding means 14 is provided beneath the tensioning means 11, and consists of a guide 15 for a traversing point, a roller 16 having a groove for traversing a yarn on the surface thereof, and a cradle 17 for holding a bobbin.

The cradle 17 is provided with a holder 18 for holding a bobbin 40 and is swingably coupled with an axis 19 as a fulcrum, and provided with a suitable surface pressure providing mean (not shown) by which the bobbin 40 is placed in contact with the roller 16 under a predetermined surface pressure.

A control means 21 consists of a circuit for inputting set data of the operation and the speed of each driving means respectively, a memory circuit for memorizing such data, a comparator for comparing new data with the data already registered therein and processing that data, and control circuit for actuating each driving means in accordance with a signal for such a processing operation or a signal from the yarn detecting means.

Figure 3:
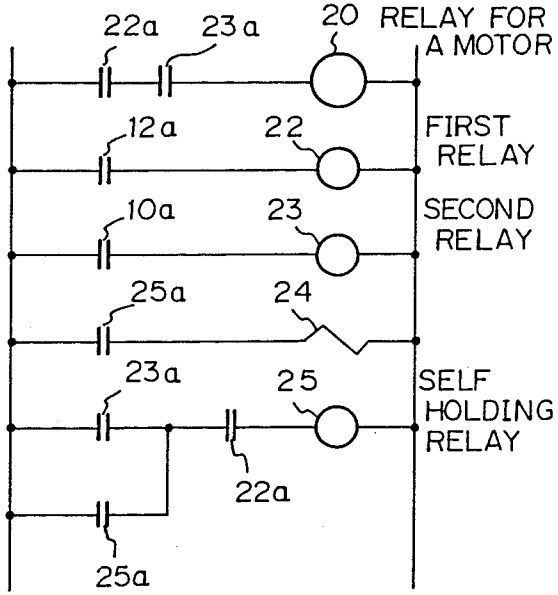
FIG. 3 is a control circuit for an electric motor which is energized periodically used in FIGS. 1 and 2.

A control circuit in FIG. 3 shows a method for controlling an electric motor 20 driving the roller 16 of the yarn winding means 14 by actuating and inactuating the motor 20 in accordance with signals output from the yarn detecting device 12 and yarn detecting means 10. Note, "actuated" and "not (or in) actuated" denote that the motor 20 is energized by a supply of electric power and the motor 20 is not energized but continues to rotate under inertia, respectively.

Figure 8:
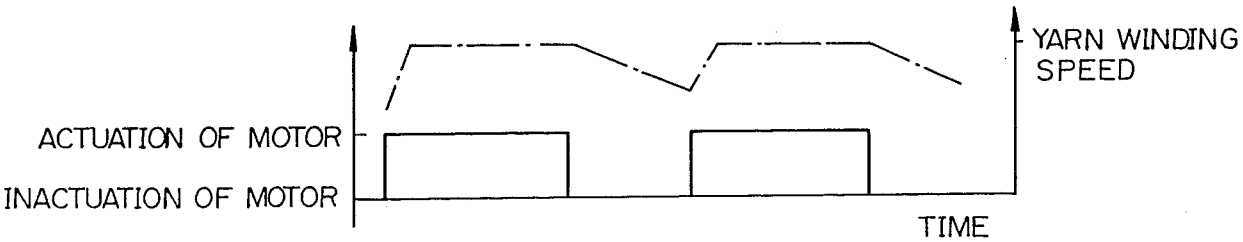
FIG. 8 is a schematic view showing a variation of a revolving speed of an electric motor controlled by actuating or not actuating the electric motor using the circuit shown in FIG. 3.

In FIG. 3, a first relay 22 makes a contact point 22*a* ON when a yarn is running in a normal condition and the yarn detecting device 12 is actuated, and a second relay 23 makes a contact point 23*a* ON when a yarn is stored inside of the yarn absorbing means 6 and the yarn detecting means 10 detects the yarn and is actuated. Accordingly, the motor 20 is actuated when both the yarn detecting means 10 and yarn detecting device 12 are actuated. Therefore, when the motor 20 is alternately actuated and not actuated, the yarn winding speed is varied as shown by a dotted line in FIG. 8.

Note, "actuated" and "not (in) actuated" when used in relation to the yarn detecting means 10 and yarn detecting device 12 denotes that both, yarn detectors detect the existence of a yarn and output corresponding signals; and neither yarn detector detects the existence of a yarn and no signals are output, respectively.

A self-holding relay 25 operates to actuate an electromagnetic mechanism 24 to actuate a tensor of the yarn tensioning means 11 when a first relay 22 and a second relay 23 are actuated and both contact points 22*a* and 23*a* are ON, or when the first relay 22 is actuated condition and the contact point 22*a* is ON and a contact point 25*a* of the self holding relay 25 is ON.

Figure 11:
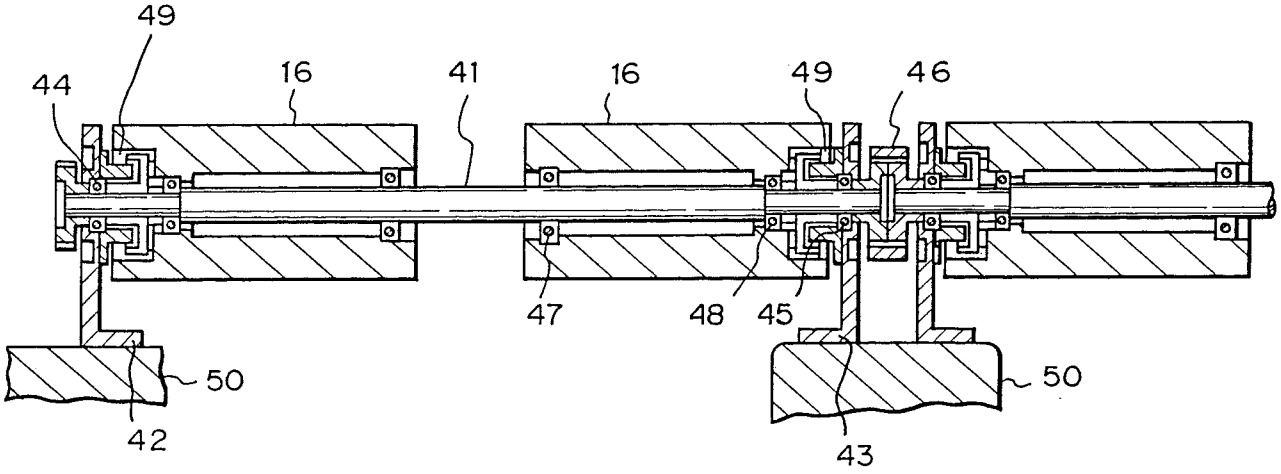
FIG. 11 is a cross sectional view showing a winding roller unit in which two winding rollers provided with an electromagnetic clutch are mounted on a driving shaft; and, FIG. 12 is an enlarged cross sectional view of a part of a winding roller showing a configuration of an arrangement of the electromagnetic clutch.

Instead of a method of controlling the electric motor 20 by directly actuating or not actuating the motor 20, alternatively, another controlling method using a yarn winding device consisting of a roller 16 having an electromagnetic clutch 49 provided inside thereof and mounted on a driving shaft 41 continuously rotated by the electric motor 20, as shown in FIG. 11, a revolving speed of the roller 16 is varied by switching the electromagnetic clutch 49 from an actuated condition to a not actuated condition vice versa, may be used in this invention.

Hereunder, an arrangement of the electromagnetic clutch 49 of this invention will be explained.

Figure 12:
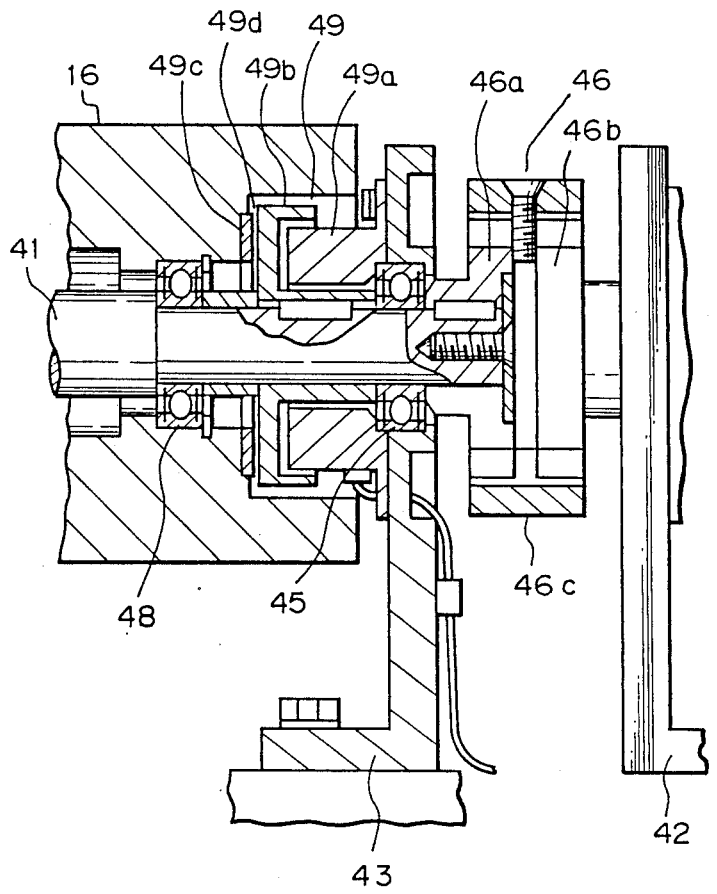

As shown in FIGS. 11 and 12, a driving shaft 41 is mounted on brackets 42 and 43 through bearings 44 and 45 and is provided with a coupling means 46*a* and 46*b* having external gear teeth on at least one edge thereof, and a roller 16 is rotatably mounted on the driving shaft 41 through bearings 47 and 48.

An electromagnetic clutch 49 is provided between one end of the roller 16 and a bracket 42 or 43, and further comprises a stator 49*a* mounted on the bracket 42 or 43, 25 a rotor 49*b* mounted on the shaft 41, and an armature, 49*c* having spring means such as a wave-shaped disc spring 49*e* provided inside of the roller 16 for keeping rotor 49*b* and the armature 49*c* separated at a predetermined distance 49*d* when the clutch is at rest. See FIG. 13A. When electric power is supplied to the coils of the stator 49*a*, the rotor 49*b* is magnetized by a magnetic flux caused by a magnetization of the stator, 49*a* so that the armature 49*c* is pulled toward and engaged with the rotor 49*b* by the magnetic force. See FIG. 13B. Armature 49*c* is returned to the original predetermined distance 49*d* from the rotor 49*b* by the spring 49*e* provided inside of the roller 16 when the attracting force is removed.

Therefore, one roller unit of the yarn winding means used in this invention consists of the brackets 42 and 43, two rollers 16 mounted on the shaft 41, the coupling means 46*a* and 46*b* mounted on both ends of the shaft 41 and the electromagnetic clutch 49 mounted on one end of each roller 16. Accordingly, the yarn winding means of this invention is constructed in such a way that a predetermined number of the roller units mentioned above are mounted on the machine frame 50, and each shaft thereof is interconnected to other shafts by the coupling means 46 having an internal gear, and finally, the end coupling means 46 is connected to the motor 20.

Moreover, another control method in which a revolving speed of a bobbin can be varied by mechanically detaching a bobbin from the surface of the roller 16 with a suitable mechanism, not shown in the Figures, can be used instead of the method of directly controlling the rotation of the motor 20 by alternately actuating or not actuating the motor 20, in this invention.

Figure 4:
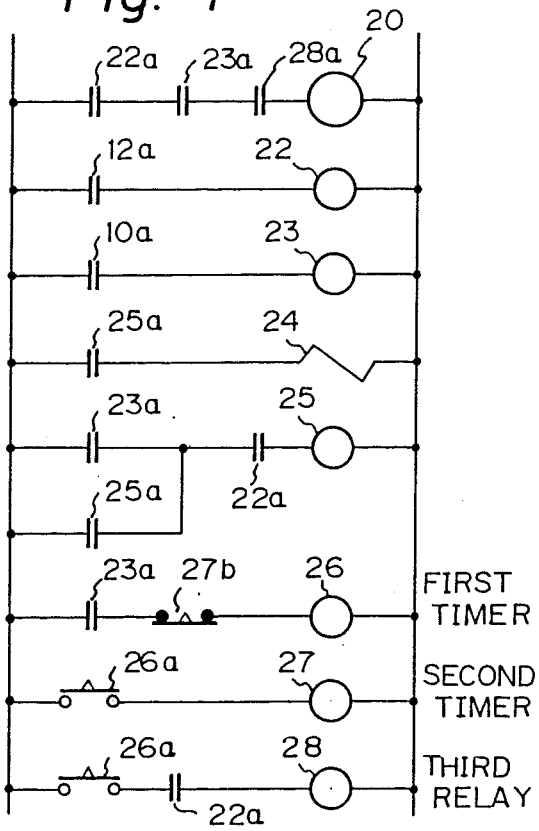
FIG. 4 is a control circuit for controlling a driving system that a motor is energized ON and OFF while a sag of yarn in the vacuum box is reducing.

A method for controlling the driving of the electric motor 20 with reference to an actuated time of the motor and an not actuated time thereof is explained hereunder with reference to FIG. 4, and a controlling circuit is shown in FIG. 4 in which a timer circuit is added to the controlling circuit shown in FIG. 3.

In FIG. 4, a first timer 26 sets a duration of a not actuated condition of the motor 20, and when a predetermined time has passed, the contact point 26*a* becomes ON. A second timer 27 sets a duration of an actuated condition of the motor 20, and within a predetermined time, the contact point 27*b* is made ON.

On the other hand, a third relay 28 makes the contact point 28*a* ON when the contact point 26*a* becomes ON after the predetermined time set in the first timer 26 has passed and the contact point 22*a* is ON, and makes the contact point 28*a* OFF when the contact point 27*b* becomes OFF after the predetermined time set in the second timer 27 has passed.

Figure 9:
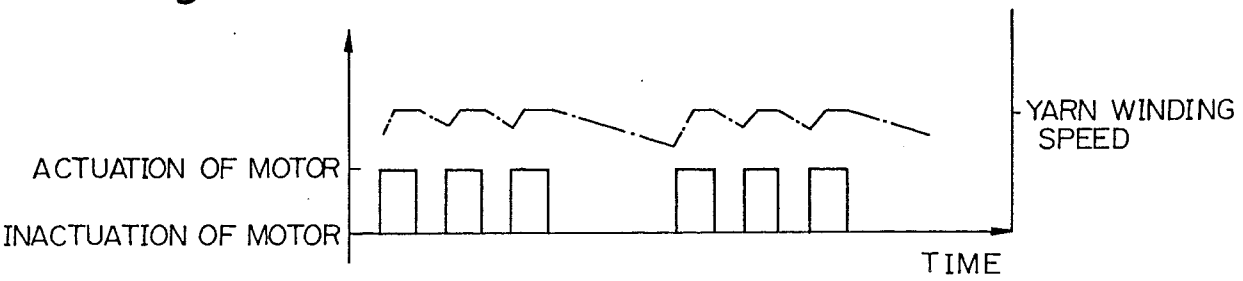
FIG. 9 is a schematic view showing a variation of a yarn winding speed when controlled with reference to an actuated and non-actuated time of the motor using the circuit shown in FIG. 4.

As mentioned above, when a motor 20 is actuated and not actuated by setting a time of the motor 20 for an inactuated condition on the first timer 26 and by setting a time for an actuated condition on the second timer 27, then the yarn winding speed is varied as shown by a dotted line in FIG. 9.

Further, another method in which a control of the driving of the electric motor 20 with reference to an actuated time of a yarn detecting means for observing a yarn running condition or to a time in which a yarn is stored in the vacuum box 7 will be described hereunder with reference to FIG. 5.

Figure 5:
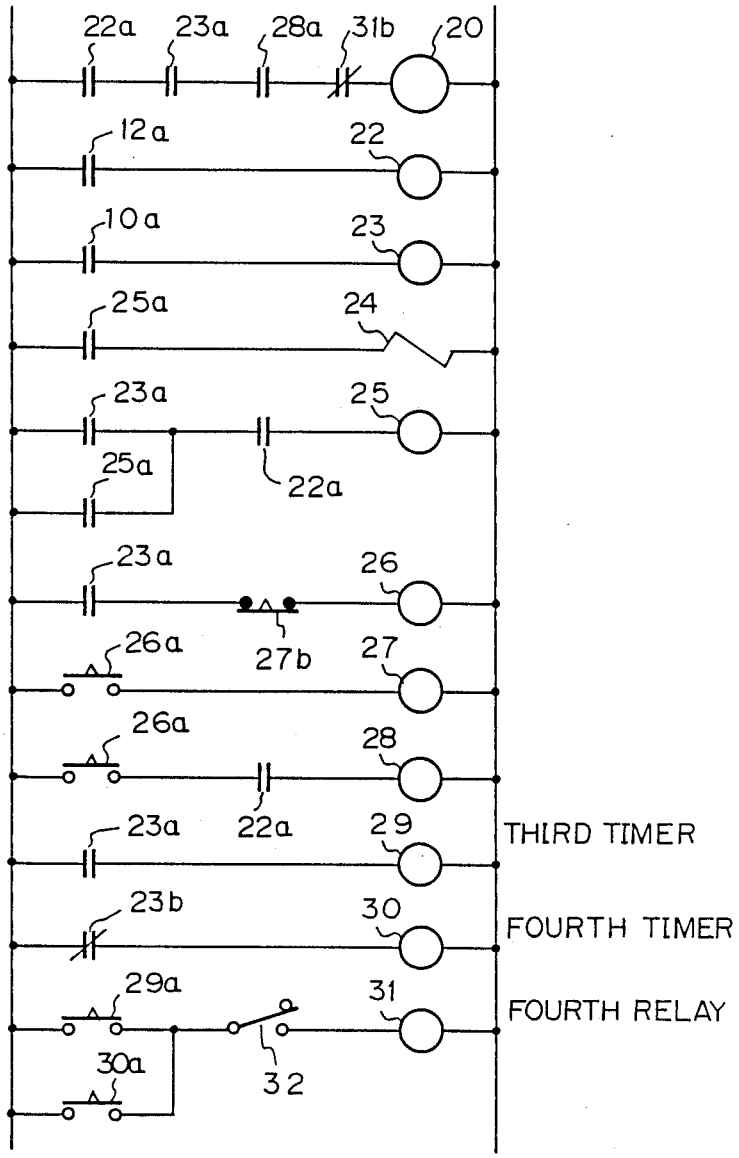
FIG. 5 is a control circuit having additional times added to the circuit in FIG. 4 for observing that a yarn is being wound normally.

In the circuit shown in FIG. 5, a timer for observing an actuated time and not actuated time of the yarn detecting means is added to the circuit shown in FIG. 4.

In the Figure, a third timer 29 observes a time when the yarn detecting means 10 provided on the absorbing means for absorbing a variation of a yarn speed detects that a yarn exists just in front of the absorbing means in view of a yarn running condition after a yarn piecing operation is finished and after the predetermined time set on the timer has passed, and makes the contact point 29a ON. A fourth timer 30 observes a time when the yarn detecting means 10 does not detect the existence of a yarn at the same place mentioned above and after the predetermined time set on the timer has passed, makes the contact point 30a ON. On the other hand, a fourth relay 31 makes the contact point 31b OFF when the contact point 29a of the third timer 29 or the contact point 30a of the fourth timer 30 is ON, if a hand operated switch 32 is contacted. This switch is provided for switching the circuit having the timers 30 and 31 to observe an actuated time and a not actuated time of the yarn detecting means 10, in or not in an operational condition.

According to this circuit, the rotation of the electric motor 20 is stopped by making the contact point 31b of the fourth relay 31 OFF when the yarn detecting means 10 detects a yarn existence even after the predetermined time set on the third timer 29 has passed, or the yarn detecting means 10 detects a yarn non-existence after the predetermined time set on the fourth timer 30 has passed.

Figure 6:
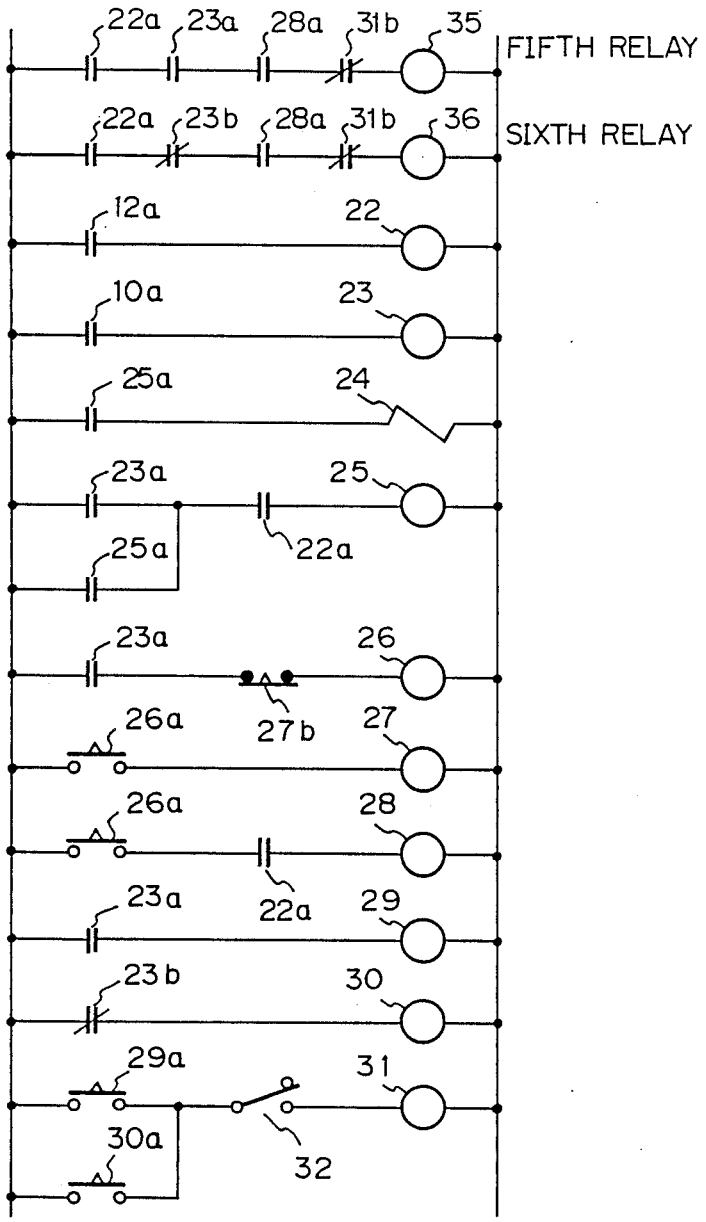
FIG. 6 and FIG. 7 are a control circuit for controlling a yarn winding speed by exchanging inverters and by energizing a motor ON and OFF with reference to a signal from a yarn detecting means indicating a yarn existence or non-existence.
Figure 7:
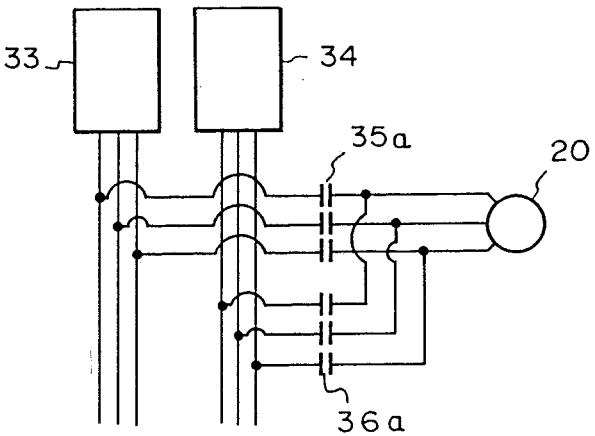

Further, another method in which a control of a yarn winding speed by increasing or decreasing that speed in accordance with a signal from a yarn detecting means 10 indicating a yarn existence or non-existence is explained hereunder, by a controlling circuit as shown in FIGS. 6 and 7.

In the Figures, an inverter 33 rotates the electric motor 20 at a speed faster than the yarn delivery speed and an inverter 34 rotates the motor 20 at nearly the same speed as the yarn delivery speed. A fifth relay 35 is provided for making the contact point 35a repeat a switching operation between ON and OFF alternately when the contact point 23a of the second relay 23 is ON while the yarn detecting means 10 outputs a yarn existence signal and the contact point 22a of the first relay 22 is ON while the yarn detecting device 12 detects a yarn existence and further, the contact point 28a of the third relay 28 repeats the ON and OFF switching while the first timer 26 and the second timer 27 are actuated and the contact point 31b of the fourth relay 31 is ON.

A sixth relay 36 is provided for making the contact point 36a repeat a switching operation between ON and OFF when the contact point 23b of the second relay 23 is ON while the yarn detecting means 10 outputs a yarn non-existence signal and the contact point 22a of the first relay 22 is ON while the yarn detecting device 12 detects a yarn existence, and further, the contact point 28a of the third relay 28 repeats the ON and OFF switching while the first timer 26 and the second timer 27 are actuated and the contact point 31b of the fourth relay 31 is ON.

When the yarn detecting means 10 detects a yarn existence, the electric motor 20 is rotated at a higher speed than the yarn delivery speed by the first inverter 33, and when the yarn detecting means 10 does not detect a yarn existence, the electric motor 20 is rotated at nearly the same speed as the yarn delivery speed by the second inverter 34.

Figure 10:
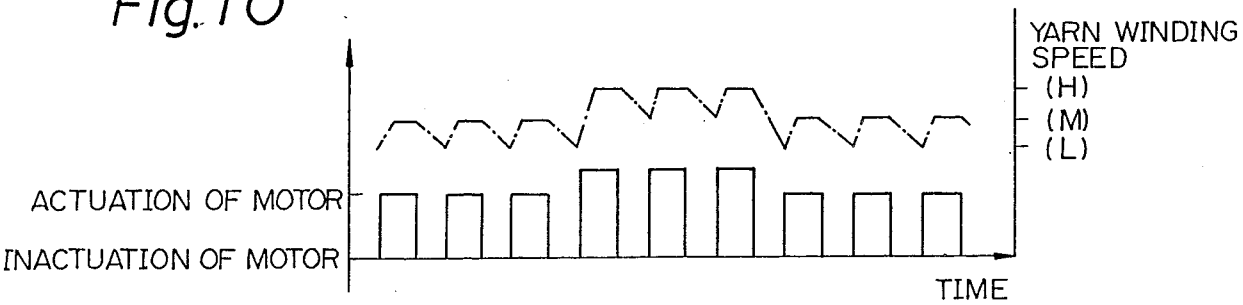
FIG. 10 is a schematic view showing a variation of a yarn winding speed of an electric motor controlled by actuating or not actuating the electric motor which is energized by two inverters alternately using the circuit shown in FIGS. 6 and 7.

Therefore, a yarn winding speed in the method mentioned above wherein the electric motor 20 is driven by setting a predetermined time at the first timer 26 and the second timer 27, respectively, varies as shown by a dotted line in FIG. 10.

In this invention, control of a yarn winding speed may be carried out by decreasing the yarn winding speed by reducing a speed of rotation of the electric motor 20 in the same manner as described above, or by intermittently removing the bobbin from the surface of the roller 16 or utilizing a bobbin shown in FIGS. 11 and 12 in which a rotation of a bobbin is reduced by intermittently not actuating the magnetic clutch.

Example 1

Practical operation of a yarn forming and a yarn winding process using a spinning machine described above is explained as follows.

Conditions of yarn forming and yarn winding steps:

| Kind of yarn: blended spun yarn, 30 S (English count) made of polyester fibers and cotton fibers | |
|---|---|
| Yarn processing speed | 220 m/min |
| Yarn winding speed | 231 m/min |
| Ratio of yarn winding speed to yarn processing speed | 1.05 |
| Width of a traverse | 150 mm |
| Yarn winding tension | 3 g |
| Diameter of wound bobbin | 200 mm |
| Negative pressure | 100 mmAq |

First, the data of the yarn processing condition and the yarn winding condition are input to the controlling means 21, and then a raw material for processing into a yarn is prepared on a portion for supplying materials and the bobbin 40 is set on the holder 18 of the cradle 17.

After these preparations are finished and the machine has started operation, the yarn forming means 1 and the yarn winding means 14 are actuated, and simultaneously, each roller is rotated at a predetermined revolving speed and a negative pressure is effected inside of the vacuum box 7 by operation of a blower (not shown).

In this situation, when a raw material for processing a yarn is supplied to a draft roller 2 of the yarn forming means 1, the yarn is spun out from the yarn forming parts 3 of the yarn forming means 1 as a spun yarn, after drafting at a predetermined drafting ratio in the draft roller 2. Then the spun yarn is delivered therefrom by nipping with the delivery roller 4 and the nip roller 5, led to the bobbin 40 of the yarn winding means 14 through the portion just in front of the sucking aperture 7a of the vacuum box 7, and wound up thereon.

At this time, the yarn detecting means 10 outputs a signal indicating that no yarn exists to the control means 21, because the yarn detecting means 10 cannot detect a yarn as a yarn has not been sucked into the vacuum box 7. Therefore, the electric motor 20 is rotated to make the roller 16 rotate at a speed lower than that of the delivery roller 4. Accordingly, as the difference in the speed between the rollers 16 and 4 slackens the yarn between the delivery roller 4 and the bobbin 40, the spun yarn is sucked into the vacuum box 7 through the sucking aperture 7a.

After the sag of the spun yarn has increased inside of the vacuum box 7 and the yarn detecting means 10 has detected a yarn existence, the yarn detecting means 10 is actuated and the output signal indicating that a yarn exists is output to the control means 21, and accordingly, the bobbin 40 is rotated at a predetermined speed to wind up the spun yarn.

In this situation, the spun yarn delivered from the delivery roller 4 is in contact with the yarn detecting device 12, and simultaneously, the yarn tensioning means 11 is actuated and the yarn cutter 13 is not actuated.

In the winding operation of a spun yarn under the conditions described above, there was no large variation in the yarn sag sucked into the vacuum box 7, and the frequency of the detection by the yarn detecting means 10 was 20 to 30 times/min, and therefore, square cheese packages having a winding density of 0.25 g/cm$^3$ and a good wound shape were obtained.

When another spun yarn winding method having the same conditions as mentioned above, except that the ratio of the yarn winding speed to the yarn processing speed was 0.99 to 1.0 which is currently used in this field, was used, it took a long time to reduce the yarn sag in the vacuum box 7 when it became large, because there was no difference between the yarn processing speed and the yarn winding speed and this caused a problem of ribbon winding or the like.

Example 2

The yarn winding method of this invention when applied to a false twisting machine is explained hereunder.

Conditions of yarn processing and yarn winding steps:

| Kind of yarn: polyester multifilament yarn 150 denier | |
|---|---|
| Yarn processing speed | 450 m/min |
| Yarn winding speed | 455 m/min |
| Ratio of yarn winding speed to yarn processing speed | 1.01 |
| Width of a traverse | 250 mm |
| Yarn winding tension | 30 g |
| Diameter of wound bobbin | 200 mm |
| Negative pressure | 100 mmAq |

The yarn winding operation was carried out under the conditions described above using the same circuit (FIG. 3) as in Example 1, but slight ribbon winding appeared in a ribbon region. Therefore, the yarn winding operation was carried out by using a separate control circuit having timers as shown in FIG. 4, each of which can set the actuating time and not actuating time of the electric motor 20 respectively, to alternately actuate and not actuate the electric motor 20 when the yarn detecting means 10 outputs the yarn existence signal.

Accordingly, the yarn winding operation was carried out under conditions such that the first timer 26 was set at 0.5 second as the not actuated time of the motor 20 and the second timer 27 was set at 0.4 second as the actuated time thereof, resulting in a variation of the yarn winding speed and the working pattern of the motor in configuration shown in FIG. 9, and finally, square cheese packages having a good wound shape and a winding density of 0.6 g/cm$^3$ without ribbon winding were obtained.

The actuated time of the electric motor 20 may be from 0.1 to 1.0 second, to obtain the same effect as above.

However, if the actuated time of the electric motor 20 is less than 0.1 second, the effect of preventing ribbon winding would not be obtained because the rotational speed of the electric motor is seldom reduced, and on the other hand, if the actuated time thereof exceeds 1.0 second, the rotational speed of the electric motor must be increased by actuation of the yarn detecting means 10 before the set time has passed because the rotational speed of the electric motor 20 has been remarkably reduced.

Accordingly, it is understood that the preferable actuated time of the electric motor is in the range of from 0.1 to 1.0 second.

Example 3

Another yarn winding method is explained hereunder in which the same conditions as in Example 2 are used except that the yarn winding speed is higher than in Example 2.

Conditions of a yarn processing and a yarn winding steps:

| Kind of a yarn: polyester multifilament yarn 150 denier | |
|---|---|
| Yarn processing speed | 900 m/min |
| Yarn winding speed | 910 m/min |
| Ratio of yarn winding speed to yarn processing speed | 1.01 |
| Width of a traverse | 250 mm |
| Yarn winding tension | 25 g |
| Diameter of wound bobbin | 250 mm |
| Negative pressure | 150 mmAq |

This yarn winding operation under the conditions described above was carried out by using the same control circuit (FIG. 4) as in Example 2, and as described above, first the electric motor 20 was not actuated in accordance with a signal from the yarn detecting mean 10 indicating a yarn non-existence caused by a reduction of the yarn sag inside of the vacuum box 7, and thereafter, was actuated in accordance with a signal from the yarn detecting mean 10 indicating the existence of a yarn caused by an increase of the yarn sag inside of the vacuum box 7. Here, much time was needed for the yarn winding speed to reach the predetermined speed from the speed when the switching operation took place, because of the increase of the yarn winding speed, and therefore many fluffs or yarn breakages occurred because the sag of the yarn stored inside of the vacuum box 7 was increased and the yarn was sucked into the vacuum duct 9, which caused the yarn to come into contact with the tube 8 or duct 9.

Accordingly, in the controlling circuit shown in FIGS. 6 and 7, the rotational speed of the electric motor 20 corresponding to the yarn winding speed can be set in three stages, such as a high speed (H) higher than the yarn processing speed, a middle speed (M) which is the same speed as the yarn processing speed, and a low speed (L) lower than the yarn processing speed. Note, in actual operation, 910 m/min, 900 m/min, and 890 m/min were input as the high speed (H), the middle speed (M) and the low speed (L), respectively, and a time of 0.5 second set as both the actuated and not actuated time of the electric motor corresponding to the signal indicating a yarn existence or non-existence from the yarn detecting means 10.

The operation of the false twisting machine was started under the above conditions, and after the motor 20 of the yarn winding means 14 was rotated at the middle speed (M) of 900 m/min and the yarn was wound on the bobbin while simultaneously taking-up a tail, the yarn was sucked into the vacuum box 7, and when the yarn was sucked in and stored at the position at which the yarn detecting means 10 was located, a signal indicating a yarn existence was sent to the control means 21.

The electric motor 20 was driven while being switched between 910 m/min and 900 m/min at 0.5 second intervals when the signal was sent from the yarn detecting means 10. On the other hand, when a signal indicating that a yarn non-existence was sent from the yarn detecting means 10 to the controlling means 21, because the sag of the stored yarn was reduced, the electric motor 20 was driven while being switched between 900 m/min and 890 m/min at 0.5 second intervals when the yarn non-existence signal was sent from the yarn detecting means 10. Accordingly, a delay of the increment of the yarn winding speed when the speed of the motor 20 was switched when the signal indicating a yarn existence was sent to the controlling means 21, depending upon the increment of the yarn sag stored, was eliminated, and accordingly, the yarn winding operation was carried out very smoothly without a remarkable change in the sag of the yarn stored in the vacuum box 7.

Example 4

Figure 2:
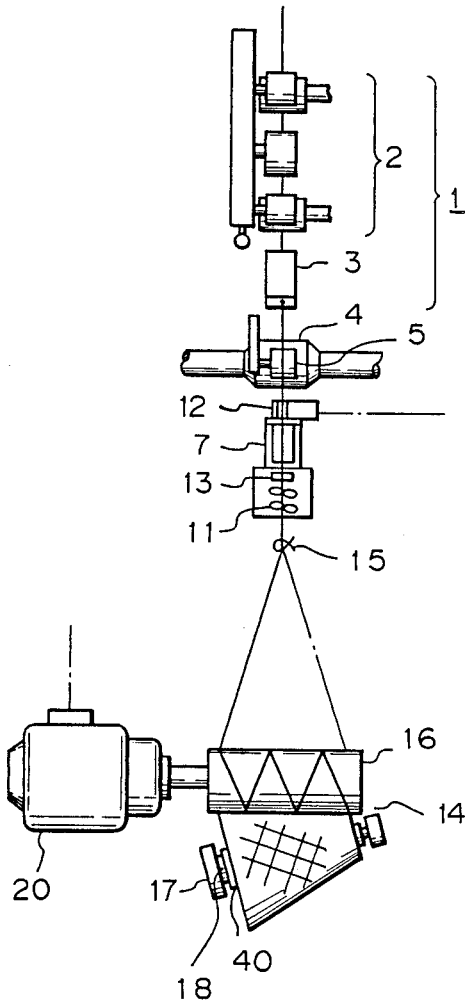
FIG. 2 is a schematic front view of a spinning machine shown in FIG. 1.

Another yarn winding method for winding up a spun yarn as a cone cheese package, in which the same spinning machine as shown in FIGS. 1 and 2 was used but a roller for driving a bobbin and a traversing mechanism were added, each of which was driven by a respective electric motor to replace the roller 16 having a groove for traversing the yarn on the surface thereof, is described hereunder.

Before starting the operation, the set position of the axis 19 as a supporting point of the swingable cradle 17 for winding the yarn was changed, so that the center axis of the bobbin was placed off-center from a central axis of the roller 16 as the volume of the yarn wound on the bobbin increased, to obtain a cone cheese package having a tapered angle of 9°15′, and the yarn processing conditions and the yarn winding conditions described below were input to the controlling means 21.

Conditions of yarn forming and yarn winding steps:

| Kind of yarn: blended spun yarn, 36 S (English count) made of polyester fibers and cotton fibers | |
|---|---|
| Yarn processing speed | 180 m/min |
| Yarn winding speed | 189 m/min |
| Ratio of yarn winding speed to yarn processing speed | 1.05 |
| Width of a traverse | 150 mm |
| Frequency of the traverse | 140 times/min |
| Yarn winding tension | 26 g |
| Diameter of wound bobbin | 200 mm |
| Cone angle | 9°15′ |
| Negative pressure | 100 mmAq |

In addition to these conditions, a time of 0.3 second for the first timer 26 and of 0.2 second for the second timer 27 were input as an actuated time and a not actuated time of the electric motor for driving the roller, respectively, corresponding to a signal indicating a yarn existence or non-existence from the yarn detecting means 10.

Under the above yarn winding conditions, a cone cheese package of spun yarn having a good shape and the yarn winding density of 0.35 g/cm$^3$ without ribbon winding was obtained.

Example 5

Another yarn winding method, in which a yarn is wound into a cone cheese package having a tapered angle of 9°15′under the same conditions as used in Example 1, exception that the yarn winding tension was changed, is explained hereunder.

Conditions of yarn forming and yarn winding steps:

| Kind of yarn: blended spun yarn, 36 S (English count) made of polyester fibers and cotton fibers | |
|---|---|
| Yarn processing speed | 220 m/min |
| Yarn winding speed | 231 m/min |
| Ratio of yarn winding speed to yarn processing speed | 1.05 |
| Width of traverse | 150 mm |
| Yarn winding tension | 31 g |
| Diameter of wound bobbin | 200 mm |
| Cone angle | 9°15′ |
| Negative pressure | 100 mmAq |

Before starting the operation, the set position of the axis 19 as a supporting point of the swingable cradle 17 was changed so that the center axis of the bobbin was placed off-center from a central axis of the roller 16 as the volume of the yarn wound on the bobbin increased, to obtain a cone cheese package having a tapered angle of 9°15′, and simultaneously, a time of 0.8 second for the first timer 26 and of 0.6 second for the second timer 27 were input to the controlling means 21 as an actuated time and a not actuated time of the electric motor for driving the roller, respectively, corresponding to a signal indicating a yarn existence or non-existence from the yarn detecting means 10.

Under the above yarn winding conditions, a cone cheese package having good shape and yarn winding density of 0.42 g/cm$^3$ without ribbon winding was obtained.

In the yarn winding method mentioned above, if a yarn breakage occurred between the yarn tensioning means 11 and the yarn winding means 14, a spun yarn upstream of the yarn breakage point was sucked into the vacuum duct 9 through the vacuum box 7 while a spun yarn downstream of the yarn breakage point was taken up by the bobbin. Accordingly, the yarn detecting device 12 sent a signal to the controlling means 21 indicating that the yarn spinning was normal, and the yarn detecting means 10 also sent a signal to the controlling means 21 indicating a yarn existence, and therefore, the yarn winding means 14 continued the yarn winding even though a yarn breakage had occurred.

Namely, another controlling circuit (shown in FIG. 5) in which the control of the electric motor 20 is carried out with reference to the actuated time of the yarn detecting means observing the running condition of the yarn or to the time in which the yarn is stored inside of the vacuum box was used, and the yarn winding operation was carried out by setting a time of 7 seconds. for the third timer 29 as the upper time limit of the actuated time of the yarn detecting means 10 and 5 seconds for the fourth timer as the upper time limit of the non actuated time of the yarn detecting means 10.

Under these conditions, the yarn winding means 14 was stopped if the winding operation continued for more than 7 seconds when an abnormal condition was detected, whether or not a yarn breakage had occurred. Accordingly, data representing a yarn breakage was detected by a yarn piecing machine (not shown) and a yarn piecing operation was immediately carried out.

As described above, this invention provides a yarn winding device which comprises a yarn feeding means for feeding a yarn at a predetermined yarn speed, an absorbing means for absorbing variations of a yarn speed by storing the yarn therein, a tensioning means for applying a predetermined tension to a yarn, and a winding means for winding a yarn on a bobbin while traversing the yarn, all of these means being arranged in the above order. The resulting device is characterized in that a yarn detecting means for detecting whether or not a yarn is in front thereof is provided in the absorbing means and a control means for controlling a yarn winding speed of a yarn winding means by increasing and decreasing that speed in accordance with a signal from the yarn detecting means, indicating a yarn existence or non-existence, is also provided, the above device mentioned provides the following effects:

(1) A variation of a yarn tension in a yarn winding operation caused by a traversing action of a yarn can be absorbed because a yarn is constantly stored inside a vacuum box at a predetermined sag by a sucking action, and this is applicable to any yarn winding operation using a wide range of a yarn winding speed of from a low speed to a high speed and a package on a bobbin having little difference in hardness between a center portion of the bobbin and an end thereof can be obtained. Further, the conditions of a package such as a hardness of a wound bobbin and the shape of the package can be freely selected.

(2) Since the control of the yarn winding speed by increasing or decreasing that speed in correspondence with a signal indicating a yarn existence from a yarn detecting means provided in an absorbing means for absorbing a variation of a yarn speed is carried out by switching the yarn winding speed to a higher speed than that of a yarn delivery speed and to nearly the same speed as the yarn delivery speed at a predetermined time interval, ribbon winding can be effectively prevented because the yarn winding speed is varied continuously and, therefore, a partial yarn accumulation in a specific area, i.e., a so-called ribbon region, is effectively eliminated.

(3) Since the control of the yarn winding speed by increasing or decreasing that speed in correspondence with a signal indicating a yarn existence or non-existence from a yarn detecting means provided in an absorbing means for absorbing a variation of a yarn speed is carried out by switching a yarn winding speed with reference to a set time, in practice, since the yarn winding means is stopped when at least one operating time exceeds a predetermined set time, which indicates an abnormal condition such as a yarn breakage, the yarn winding means can be immediately stopped and a yarn piecing operation carried out even when a yarn breakage occurs downstream of a yarn detecting device provided upstream of an absorbing means for absorbing a variation of a yarn speed.

Further, a decrease in yarn quality, caused by the contact of a yarn with a surface of a roller, is prevented.

We claim:

1. A yarn winding device which comprises:

yarn feeding means for feeding a yarn at a predetermined speed, yarn winding means for winding the yarn on a bobbin while traversing said yarn back and forth across the bobbin, absorbing means located between the yarn feeding means and the winding means for absorbing variations in the winding speed of the yarn fed from the yarn feeding means by storing the yarn therein in a U-shaped loop, said absorbing means comprising a vacuum box and means for creating a negative pressure therein, whereby the loop of the yarn is pulled into the box by a suction air flow created by the negative pressure, detecting means generating a signal in response to the presence or lack of presence of the yarn loop in the absorbing means, tensioning means for mechanically applying a predetermined tension to the yarn located downstream of the absorbing means, and control means for controlling the yarn winding speed of the yarn winding means in response to signals from the yarn detecting means wherein when the detecting means signals the presence of the yarn loop in the absorbing means, the control means operates the winding means at a higher yarn winding speed in which the yarn winding speed is higher than the speed at which the yarn is fed by the yarn feeding means at a predetermined constant ratio and when the detecting means signals the lack of the presence of the yarn loop in the absorbing means, the control means operates the yarn winding means at a lower yarn winding speed in which the average yarn winding speed is lower than the speed at which the yarn is fed by the feeding means.

2. A yarn winding device which comprises:

yarn feeding means for feeding a yarn at a predetermined speed, yarn winding means for winding the yarn on a bobbin while traversing the yarn back and forth across the bobbin, absorbing means located between the yarn feeding means and the winding means for absorbing variations in the winding speed of the yarn fed from the yarn feeding means by storing the yarn therein in a U-shaped loop, said absorbing means comprising a vacuum box and means for creating a negative pressure therein, whereby the loop of the yarn is pulled into the box by a suction air flow created by the negative pressure, detecting means generating a signal in response to the presence or lack of presence of the yarn loop in the absorbing means, tensioning means for mechanically applying a predetermined tension to the yarn, located downstream of the absorbing means, and control means for controlling the yarn winding speed of the winding means in response to signals from the yarn detecting means, wherein when the detecting means signals the presence of the yarn loop in the absorbing means, the control means intermittently changes the speed of the winding means in a predetermined time period between a yarn winding speed that is higher than the speed at which the yarn is fed by the yarn feeding means and a lower speed, but in which the average higher yarn winding speed is higher than the sped at which the yarn is fed by the yarn feeding means at a predetermined constant ratio and when the detecting means signals the lack of the presence of the yarn loop in the absorbing means, the control means intermittently changes the speed of the winding means in a predetermined time period between a winding speed that is nearly the same as the speed at which the yarn is fed by the yarn feeding means and a lower speed, but in which the average lower yarn winding speed is lower than the speed at which the yarn is fed by the yarn feeding means.

3. The yarn winding device of claim 2, wherein said intermittent changing of the yarn winding speed of the yarn winding means is carried out at a predetermined time period of from 0.1 to 1.0 seconds.

4. The yarn winding device of claim 1 or 2, wherein said means for controlling the winding speed further includes a circuit for stopping the yarn winding means when the yarn winding speed is not switched between said higher yarn winding speed and said lower yarn winding speed after a predetermined time interval has passed.

5. The yarn winding device of claim 1 or 2, wherein the tensioning means is located adjacent to the opening of said vacuum box.

6. The yarn winding device of claim 1 or 2, wherein said control means include a timer for counting a predetermined time interval and generating a signal upon completion of the interval, and wherein said tensioning means is alternatively activated and deactivated in response to the signal received from the yarn detecting means indicating the presence of the yarn loop in the absorbing means and the signal received from the timer.

7. The yarn winding device according to claim 1 or 2, wherein the switching of the speed of the yarn winding means is carried out by the control means changing the rotating speed of the bobbin and the traversing speed of the yarn on the bobbin.

8. The yarn winding device of claim 1 wherein said yarn winding means includes a rotating bobbin and a main motor for rotating the bobbin and wherein the winding speed of the bobbin is varied by the control means increasing or decreasing the speed of the motor.

9. The yarn winding device of claim 8, wherein said means further includes an auxiliary motor for rotating the bobbin at a speed different than the main motor and the winding speed of the bobbin is varied by the control means activating one or the other of the motors.

10. The yarn winding device of claim 1 wherein said yarn winding means includes a rotating bobbin and a motor for rotating the bobbin and wherein the winding speed of the bobbin is varied by the control means switching the rotating bobbin between a condition where it is driven by the motor and a non-driven condition.

11. The yarn winding device of claim 10, wherein said yarn winding means includes a clutch means between the motor and the rotating bobbin and the control means switches the clutch means between a condition in which said motor and said rotating bobbin are connected and a condition in which said motor and said bobbin are disconnected.

12. The yarn winding device of claim 10, wherein said yarn winding means includes a bobbin rotating roller connected to said motor that rotates the bobbin by contact of the bobbin with a surface of said roller, said winding speed of the bobbin being varied by the control means engaging and disengaging the surface of said rotating roller with said bobbin in correspondence with the signals from said detecting means.

13. The yarn winding device of claim 10, wherein said motor has a drive shaft and said yarn winding means includes a winding roller on which the bobbin is mounted that is rotatably mounted on the drive shaft, and an electromagnetic clutch activated by the control means for coupling and uncoupling the winding roller and the drive shaft.

14. The yarn winding device of claim 13, wherein the electromagnetic clutch comprises a stator mounted on a bearing support for the drive shaft, a rotor mounted on the drive shaft, an armature mounted on the winding roller adjacent to the rotor and spring means for separating the rotor and armature when the clutch is at rest, whereby activation of the stator pulls the armature into engagement with the rotor to rotate the winding roller.

15. The yarn winding device of claim 14, wherein the yarn winding means includes at least two winding rollers rotatably mounted on the drive shaft with at least one end of each winding roller being connected through an electromagnetic clutch to the drive shaft.

16. The yarn winding device of claim 2 wherein said yarn winding means includes a rotating bobbin and a main motor for rotating the bobbin and wherein the winding speed of the bobbin is varied between the higher and lower speeds by the control means increasing or decreasing the speed of the motor.

17. The yarn winding device of claim 16, wherein said means further includes an auxiliary motor for rotating the bobbin at a speed different than the main motor and the winding speed of the bobbin is varied by the control means activating one or the other of the motors.

18. The yarn winding device of claim 16 wherein the winding speed of the bobbin is changed intermittently at the higher and lower speeds by the control means switching the rotating bobbin between a condition where it is driven by the motor and a non-driven condition.

19. The yarn winding device of claim 18, wherein said yarn winding means includes a clutch means between the motor and the rotating bobbin and the control means intermittently switches the clutch means between a condition in which said motor and said rotating bobbin connected and a condition in which said motor and said bobbin are disconnected.

20. The yarn winding device of claim 18, wherein said yarn winding means includes a bobbin rotating roller connected to said motor that rotates the bobbin by contact of the bobbin with a surface of said roller, said winding speed of the bobbin being intermittently changed by the control means engaging and disengaging the surface of said rotating roller with said bobbin.

21. The yarn winding device of claim 18, wherein said motor has a drive shaft and said yarn winding means includes a winding roller on which the bobbin is mounted that is rotatably mounted on the drive shaft, and an electromagnetic clutch activated by the control means for intermittently coupling and uncoupling the winding roller and the drive shaft.

22. The yarn winding device of claim 21, wherein the electromagnetic clutch comprises a stator mounted on a bearing support for the drive shaft, a rotor mounted on the drive shaft, an armature mounted on the winding roller adjacent to the rotor and spring means for separating the rotor and armature when the clutch is at rest, whereby activation of the stator pulls the armature into engagement with the rotor to rotate the winding roller.

23. The yarn winding device of claim 22 wherein the yarn winding means includes at least two winding rollers rotatably mounted on the drive shaft with at least one end of each winding roller being connected through an electromagnetic clutch to the drive shaft.

* * * * *